US011780640B2

(12) United States Patent
Little et al.

(10) Patent No.: US 11,780,640 B2
(45) Date of Patent: Oct. 10, 2023

(54) ONE PIECE CONTAINER WITH INTERNAL CORNER SUPPORTS

(71) Applicant: YORK CONTAINER COMPANY, York, PA (US)

(72) Inventors: Troy M. Little, Thomasville, PA (US); Thomas E. DeCello, Spring Grove, PA (US)

(73) Assignee: YORK CONTAINER COMPANY, York, PA (US)

( * ) Notice: Subject to any disclaimer, the term of this patent is extended or adjusted under 35 U.S.C. 154(b) by 0 days.

(21) Appl. No.: 17/526,672

(22) Filed: Nov. 15, 2021

(65) Prior Publication Data

US 2023/0150717 A1 May 18, 2023

(51) Int. Cl.

| | |
|---|---|
| ***B65D 5/44*** | (2006.01) |
| ***B65D 5/16*** | (2006.01) |
| ***B65D 5/42*** | (2006.01) |
| ***B65D 5/02*** | (2006.01) |

(52) U.S. Cl.

CPC ..... *B65D 5/443* (2013.01); *B65D 5/0281* (2013.01); *B65D 5/16* (2013.01); *B65D 5/4266* (2013.01)

(58) Field of Classification Search

CPC ..... B65D 5/443; B65D 5/541; B65D 5/542; B65D 5/001; B65D 5/16; B65D 5/0281

USPC ..... 229/240, 122.32, 122.33, 165, 172, 174, 229/181, 182, 167, 168, 191, 918, 919

See application file for complete search history.

(56) References Cited

U.S. PATENT DOCUMENTS

| | | | | |
|---|---|---|---|---|
| 3,055,573 | A | 9/1962 | Carter | |
| 4,101,048 | A | 7/1978 | Rieben | |
| 5,535,942 | A | 7/1996 | Vilona | |
| 6,817,514 | B2 * | 11/2004 | Kanter | B65D 5/001 229/918 |
| 6,948,617 | B2 * | 9/2005 | Kanter | B65D 5/16 206/769 |
| 7,677,433 | B2 | 3/2010 | Little | |
| 7,810,707 | B2 | 10/2010 | Little | |
| 7,819,305 | B2 | 10/2010 | Little | |
| 7,861,916 | B2 | 1/2011 | Little | |
| 7,981,017 | B2 | 7/2011 | Little et al. | |
| 8,177,117 | B2 | 5/2012 | Little | |
| 8,297,490 | B2 | 10/2012 | Little et al. | |
| 8,887,985 | B2 | 11/2014 | Laughman et al. | |
| 8,925,795 | B2 | 1/2015 | Little | |
| 9,022,276 | B2 | 5/2015 | Little | |
| 9,290,294 | B2 * | 3/2016 | Laughman | B65D 5/542 |
| 9,315,287 | B2 * | 4/2016 | Wintermute | B65D 5/445 |
| 9,434,501 | B2 | 9/2016 | Little | |
| 10,829,263 | B1 | 11/2020 | Little | |

(Continued)

*Primary Examiner* — Nathan J Newhouse
*Assistant Examiner* — Phillip D Schmidt
(74) *Attorney, Agent, or Firm* — Barnes & Thornburg LLP

(57) ABSTRACT

A retail-ready container includes internal corner supports. The container is erected from a preassembly formed from a single blank. The blank includes a side panel, a bottom panel, and an auxiliary panel. Each of the side panel and the auxiliary panel include a plurality of sections connected by respective fold lines. The auxiliary panel is folded against the side panel and sections of the auxiliary panel are adhered to corresponding sections of the side panel. Fold lines of the side panel are laterally offset from fold lines of the auxiliary panel so that unfolding of the preassembly yields the container with internal corner supports.

21 Claims, 15 Drawing Sheets

(56) References Cited

U.S. PATENT DOCUMENTS

| | | | | |
|---|---|---|---|---|
| 11,472,595 | B1 * | 10/2022 | Rhodes | A47B 47/06 |
| 2010/0083618 | A1 | 4/2010 | Little | |
| 2010/0087304 | A1 | 4/2010 | Little | |
| 2010/0120594 | A1 * | 5/2010 | Little | B65D 5/0075 493/56 |
| 2011/0011922 | A1 | 1/2011 | Little | |
| 2016/0200062 | A1 * | 7/2016 | Wintermute | B65D 5/5054 493/63 |
| 2017/0240315 | A1 | 8/2017 | Little | |
| 2019/0009946 | A1 * | 1/2019 | Nixon | B65D 5/4266 |
| 2021/0331827 | A1 * | 10/2021 | Gressel | B65D 5/4608 |

* cited by examiner

ONE PIECE CONTAINER WITH INTERNAL CORNER SUPPORTS

BACKGROUND AND SUMMARY OF THE DISCLOSURE

Retail-ready containers with internal corner supports are known in the art. Some such containers include the corner supports as structures separate from the container itself. The present disclosure is directed to a retail-ready container including integral internal corner supports. The retail-ready container according to the present disclosure may be erected from a preassembly formed from a single blank.

BRIEF DESCRIPTION OF THE DRAWINGS

FIG. 1A is a detail view of a portion of the blank of FIG. 1;

FIG. 1B is a detail view of a second portion of the blank of FIG. 1;

FIG. 1C is a detail view of a third portion of the blank of FIG. 1;

FIG. 1D is a detail view of a fourth portion of the blank of FIG. 1;

DETAILED DESCRIPTION OF THE DRAWINGS

Figure 1:
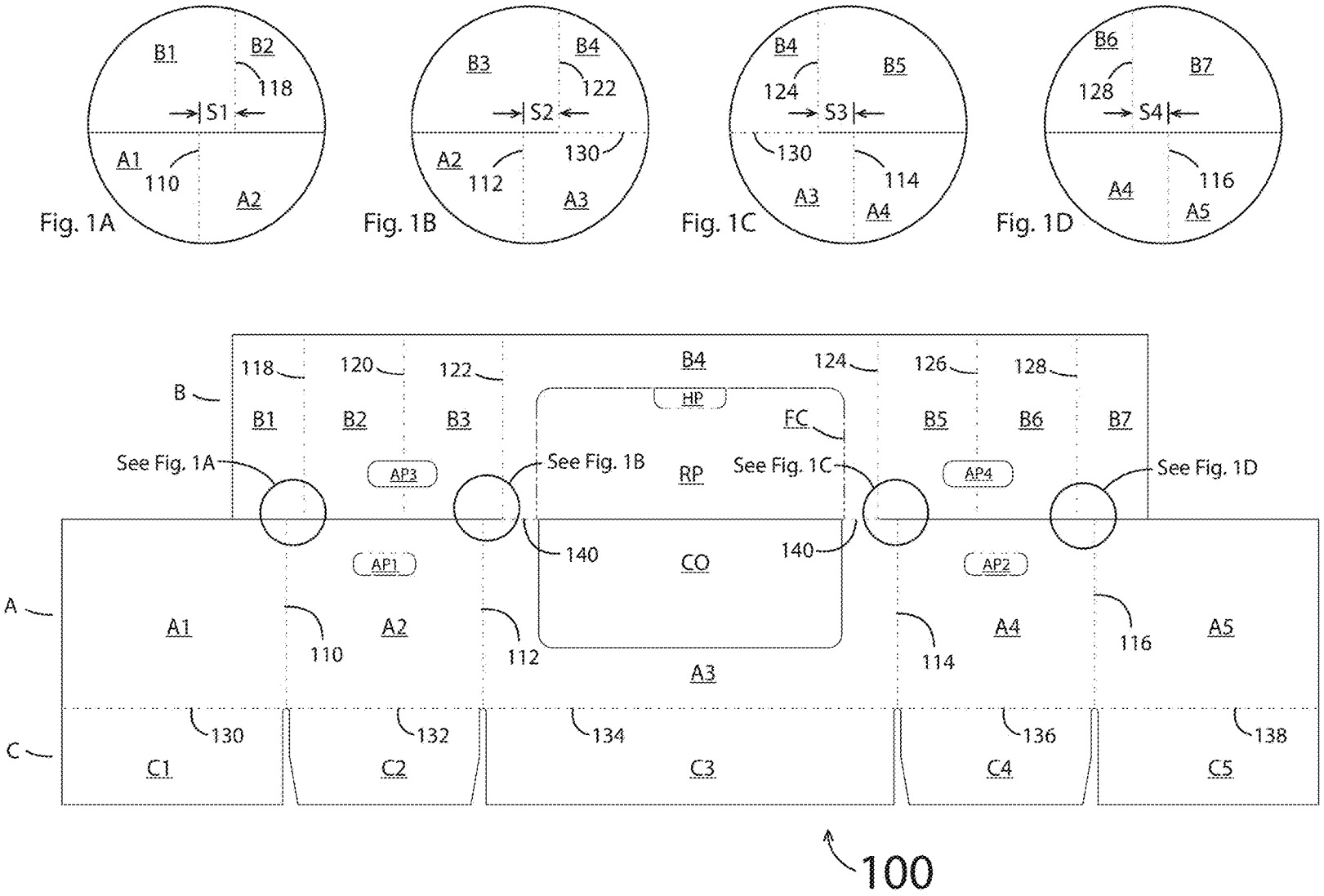
FIG. 1 is a plan view of a blank from which a first embodiment of a container may be erected according to the present disclosure.

References to orientation, for example, top, bottom, front, rear, center, side, left, right and alike as may be used herein should be construed in a relative, rather than absolute, sense unless contexts clearly dictates otherwise. Embodiments shown and described herein are illustrative and should not be considered as limiting the scope of the invention as defined by the appended claims. Features disclosed in connection with a given embodiment may be used in connection with any other embodiment to the greatest extent possible.

The drawings show an illustrative one-piece blank 100, an illustrative one-piece preassembly 102 made from the blank 100, and an illustrative container 104 erected from the preassembly 102 according to the present disclosure.

The blank 100 includes a side panel A, an auxiliary panel B, and a bottom panel C. The blank 100 maybe made of corrugated paperboard, cardstock or another suitable material. Solid lines between adjacent panels as shown in the drawings indicate separation of the adjacent panels from each other. Separation may be effected for example by lancing, shearing, die cutting or other means that may or may not yield a kerf. Dashed lines as shown in the drawings indicate fold lines that may or may not be scored. Scoring, where provided, may be effected by perforating or creasing the blank 100.

FIG. 1 shows an inner surface of the blank 100, including the side panel A, the auxiliary panel B, and the bottom panel C. The side panel A includes first though fifth sections A1, A2, A3, A4, A5, as will be discussed further below. The auxiliary panel B includes first though seventh sections B1, B2, B3, B4, B5, B6, B7 as will be discussed further below. The bottom panel C includes first though fifth sections C1, C2, C3, C4, C5, as will be discussed further below.

The first section A1 of the side panel A is connected to the second section A2 of the side panel A by a first fold line 110. The second section A2 of the side panel A is connected to the third section A3 of the side panel A by a second fold line 112. The third section A3 of the side panel A is connected to the fourth section A4 of the side panel A by a third fold line 114. The fourth section A4 of the side panel A is connected to the fifth section A5 of the side panel A by a fourth fold line 116. The first through fourth fold lines 110, 112, 114, 116 are parallel to and laterally spaced from each other.

The second section A2 of the side panel A defines a first aperture AP1. The fourth section A4 of the side panel A defines a second aperture AP2. The first and second apertures AP1, AP2 are shown as generally rectangular but could take other shapes. The third section A3 of the side panel defines a U-shaped cutout CO.

The first section B1 of the auxiliary panel B is connected to the second section B2 of the auxiliary panel B by a fifth fold line 118. The second section B2 of the auxiliary panel B is connected to the third section B3 of the auxiliary panel B by a sixth fold line 120. The third section B3 of the auxiliary panel B is connected to the fourth section B4 of the auxiliary panel B by a seventh fold line 122. The fourth section B4 of the auxiliary panel B is connected to the fifth section B5 of the auxiliary panel B by an eighth fold line 124. The fifth section B5 of the auxiliary panel B is connected to the sixth section B6 of the auxiliary panel B by a ninth fold line 126. The sixth section B6 of the auxiliary panel B is connected to the seventh section B7 of the auxiliary panel B by a tenth fold line 128. The fifth through tenth fold lines 118, 120, 122, 124, 126, 128 are parallel to and laterally spaced from each other. Also, the fifth through tenth fold lines 118, 120, 122, 124, 126, 128 are parallel to the first fold line 110.

The second and third sections B2, B3 of the auxiliary panel B cooperate to define a third aperture AP3. The fifth and sixth sections B5, B6 of the auxiliary panel B cooperate to define a fourth aperture AP4. The third and fourth apertures AP3, AP4 are shown as generally rectangular and similar to the first and second apertures AP1, AP2 but could take other shapes.

The first portion C1 of the bottom panel C is connected to the first section A1 of the side panel A by an eleventh fold line 130. The second section C2 of the bottom panel C is connected to the second section A2 of the side panel A by a twelfth fold line 132. The third section C3 of the bottom panel C is connected to the third section A3 of the side panel A by a thirteenth fold line 134. The fourth section C4 of the bottom panel C is connected to the fourth section A4 of the side panel A by a fourteenth fold line 136. The fifth section C5 of the bottom panel C is connected to the fifth section A5 of the side panel A by a fifteenth fold line 138. The eleventh through fifteenth fold lines 130, 132, 134, 136, 138 are co-linear with each other and perpendicular to the first fold line 110.

The fourth section B4 of the auxiliary panel B is connected to the third section A3 of the side panel A by a sixteenth fold line 140. The sixteenth fold line 140 is perpendicular to the first fold line 110.

A removable portion RP is frangibly connected to the fourth section B4 of the auxiliary panel B by a frangible connection FC. The removable portion RP is shown as rectangular, but could take other shapes. The removable portion RP cooperates with the fourth section B4 of the auxiliary panel B to define a hinged portion HP that may be manipulated to facilitate removal of the removable portion as will be discussed further below. The hinged portion HP is frangibly connected to the removable portion RP.

The removable portion RP has a shape complementary to the shape of the cutout CO defined by the third section A3 of the side panel A. In embodiments, the removable panel RP extends beyond the free edge of the third section A3 of the side panel A3 defining the cutout CO by an amount sufficient to enable the third section A3 of the side panel A to obscure the frangible connection FC when the blank 100 is manipulated into the container 104, while at the same time not adversely inhibiting removal of the removable portion RP from the container 104, as will be discussed further below.

In embodiments, the removable portion RP, the hinged portion HP, and the frangible connection FC may be omitted. In such embodiments, the space occupied by the removable portion RP and hinged portion HP as shown in the drawings could be empty or embodied as an extension of the fourth section B3 of the auxiliary panel B.

Figure 1E:
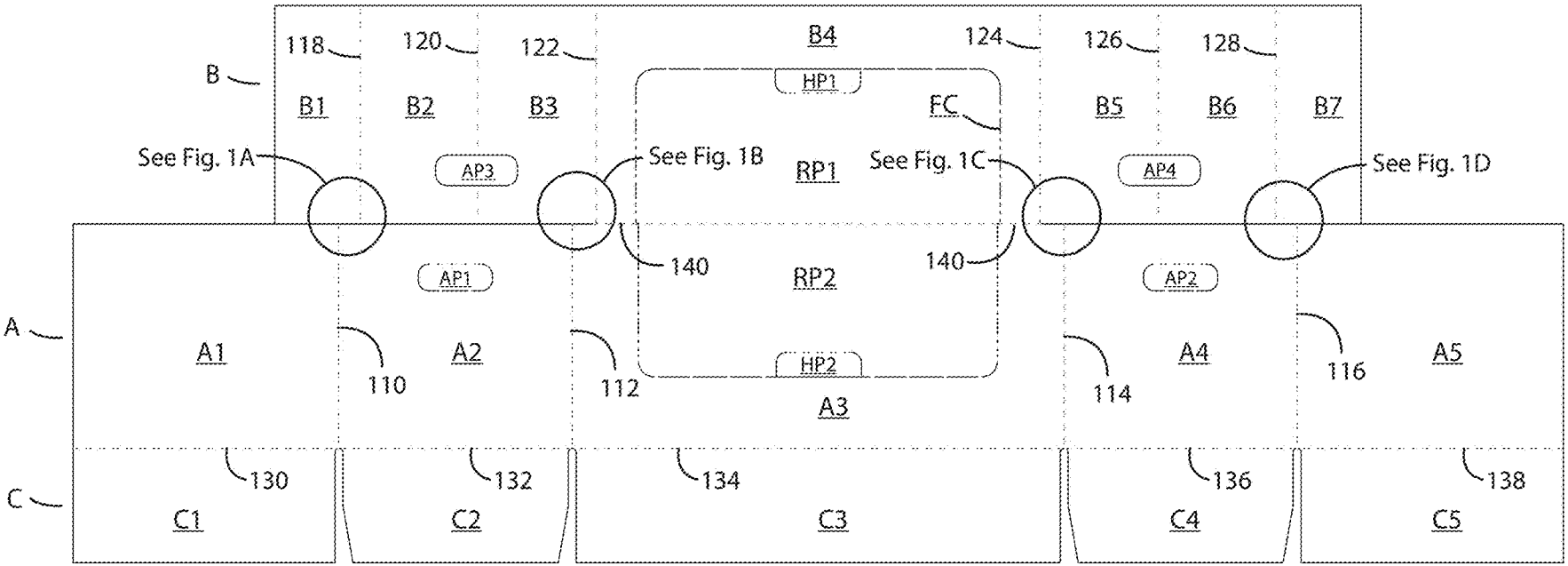
FIG. 1E is a plan view of an alternative blank from which a first embodiment of a container may be erected according to the present disclosure.

In embodiments, for example, as shown in FIG. 1E, the cutout CO may be omitted, and the removable portion RP may include a first section RP1 joined to the fourth section B4 of the auxiliary panel by the frangible connection FC, and a second section RP2 extending into and joined to the third section A3 of the side panel A by the frangible connection FC. In such embodiments, the portion of the frangible connection FC joining the first section RP1 of the removable panel RP to the fourth section B4 of the auxiliary panel B extends beyond the portion of the frangible connection FC joining the second section RP2 of the removable portion RP to the third section A3 of the side panel A by an amount sufficient to enable the third section A3 of the side panel A to obscure the portion of the frangible connection FC joining the first section RP1 of the removable portion RP to the fourth section B4 of the auxiliary panel B when the blank 100 is manipulated into the container 104, while at the same time not adversely inhibiting removal of the removable portion RP from the container 104, as will be discussed further below.

As shown in FIG. 1 and better shown in FIG. 1A, the fifth fold line 118 connecting the first and second sections B1, B2 of the auxiliary panel B to each other is laterally offset from the first fold line 110 connecting the first and second sections A1, A2 of the side panel A to each other by a first distance S1. An imaginary extension of the fifth fold line 118 is directed through the second section A2 of the side panel A proximate the first fold line 110.

As shown in FIG. 1 and better shown in FIG. 1B, the seventh fold line 122 connecting the third and fourth sections B3, B4 of the auxiliary panel B to each other is laterally offset from the second fold line 112 connecting the second and third sections A2, A3 of the side panel A to each other by a second distance S2. An imaginary extension of the seventh fold line 122 is directed through the third section A3 of the side panel A proximate the second fold line 112.

As shown in FIG. 1 and better shown in FIG. 1C, the eighth fold line 124 connecting the fourth and fifth sections B4, B5 of the auxiliary panel B to each other is laterally offset from the third fold line 114 connecting the third and fourth sections A3, A4 of the side panel A to each other by a third distance S3. An imaginary extension of the eighth fold line 124 is directed through the third section A3 of the side panel A proximate the third fold line 114.

As shown in FIG. 1 and better shown in FIG. 1D, discussed above, the tenth fold line 128 connecting the sixth and seventh sections B6, B7 of the auxiliary panel B to each other is laterally offset from the fourth fold line 116 connecting the fourth and fifth sections A4, A5 of the side panel A to each other by a fourth distance S4. An imaginary extension of the tenth fold line 128 is directed through the fourth section A4 of the side panel A proximate the fourth fold line 116.

Figure 12:
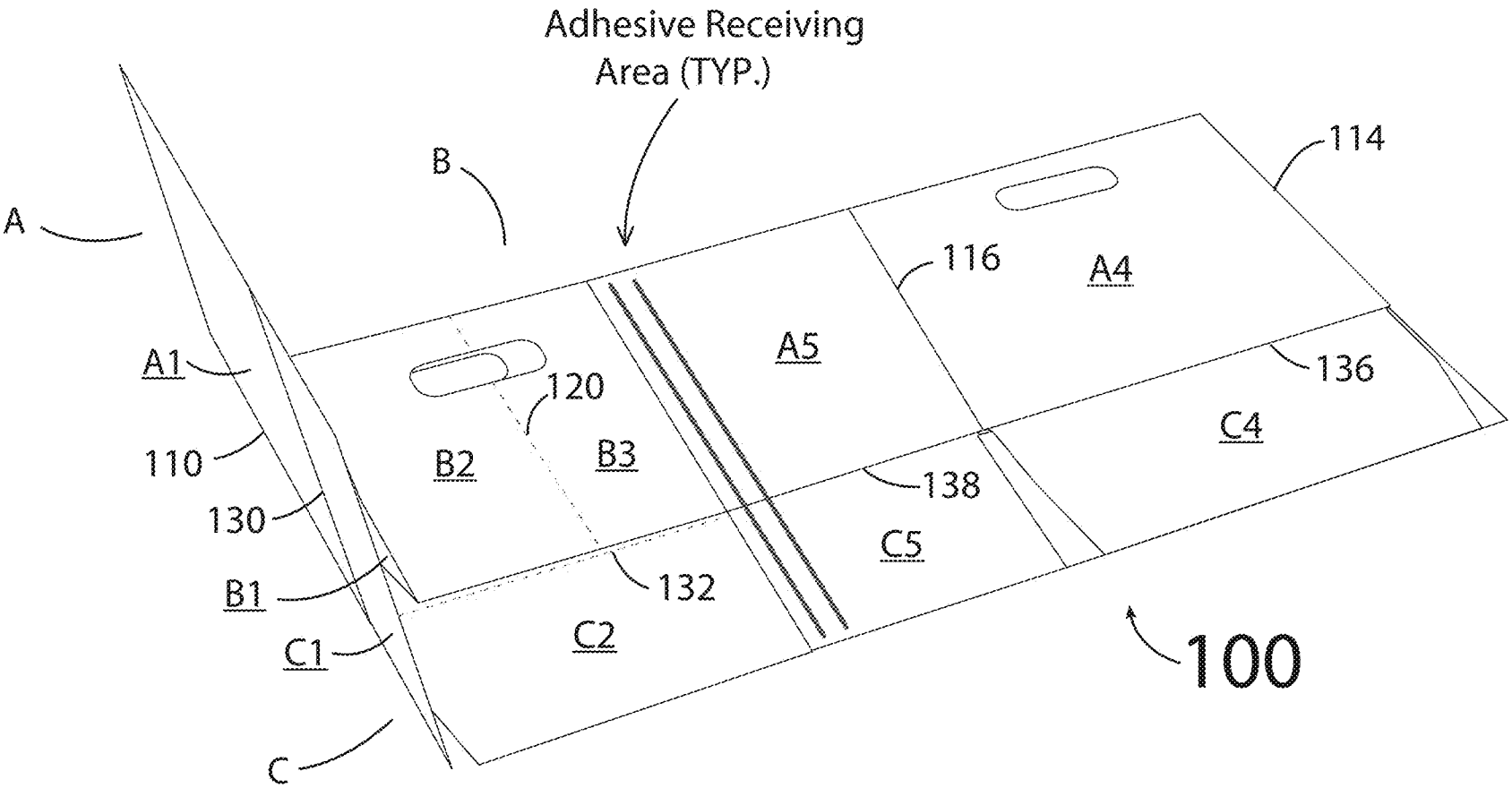
FIG. 12 is a perspective view of the blank of FIG. 1 yet further manipulated to form a preassembly according to the second aspect of the present disclosure.
Figure 13:
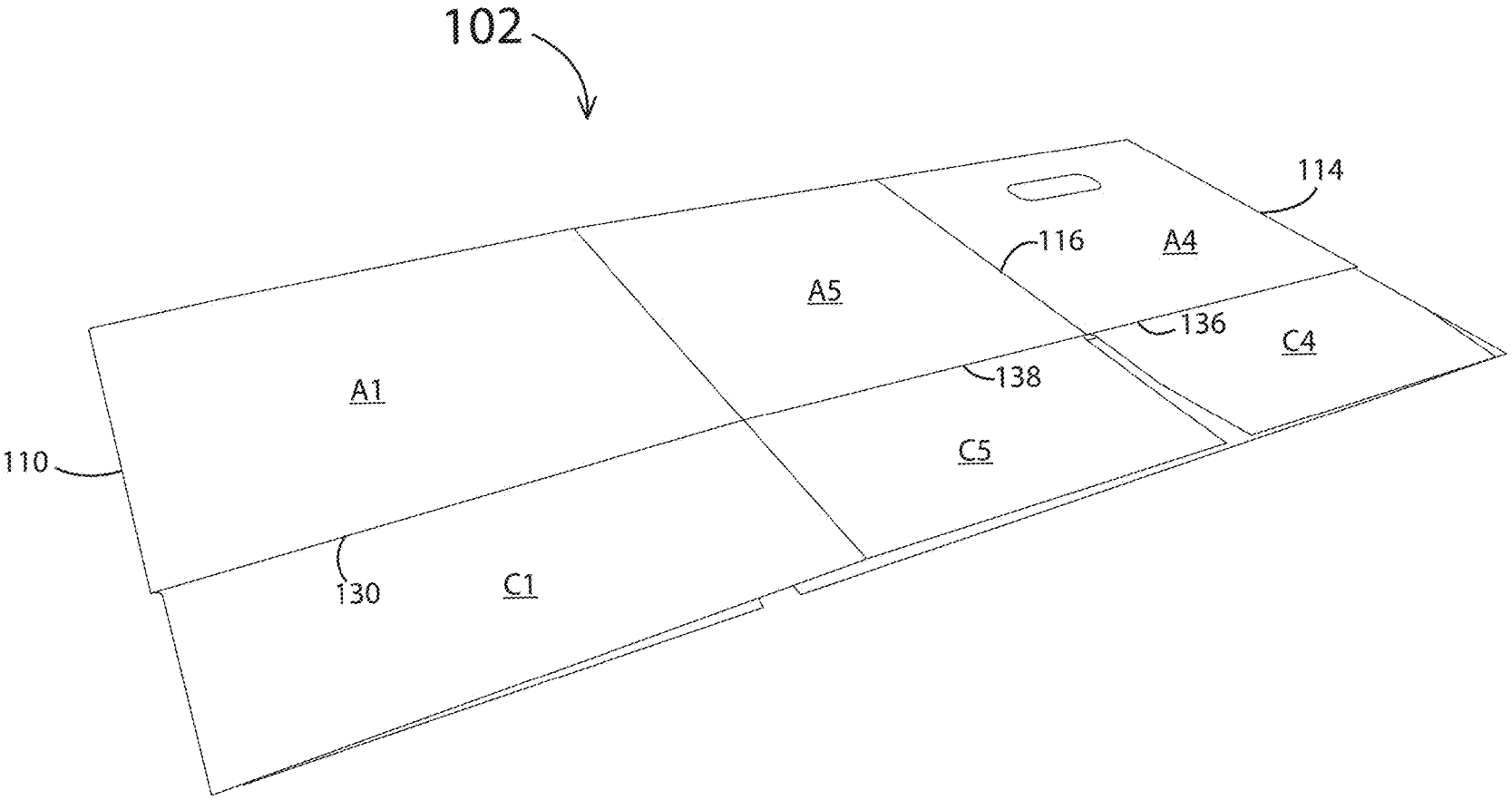
FIG. 13 is a perspective view of a preassembly formed from the blank of FIG. 1.

FIG. 13 shows a preassembly 102 according to the present disclosure. FIGS. 2-7 show an illustrative sequence of construction of the preassembly 102 according to a first aspect of the present disclosure, as will be discussed further below. FIGS. 8-12 show an illustrative sequence of construction of the preassembly 102 according to a second aspect of the present disclosure, as will be discussed further below.

Figure 2:
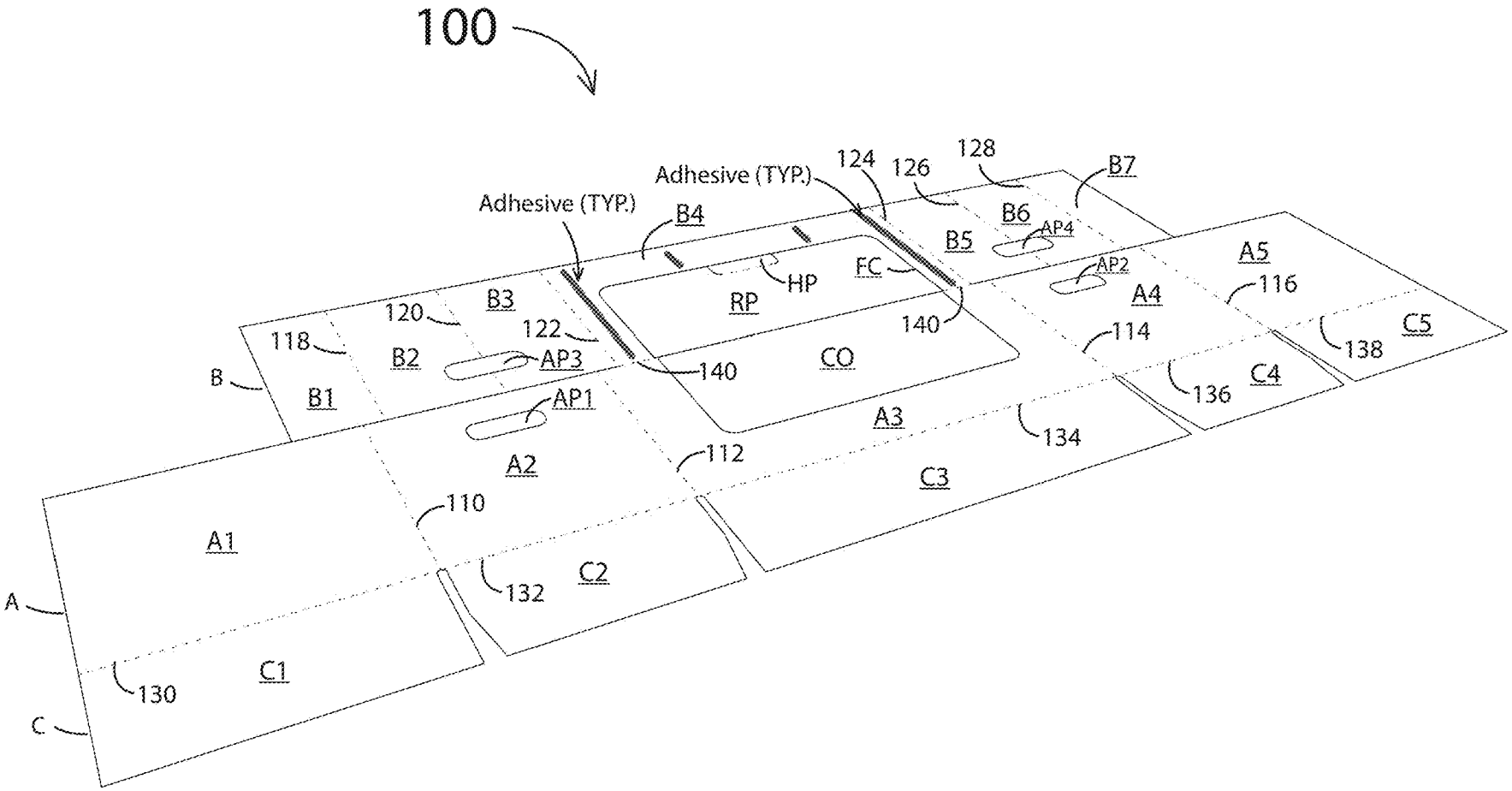
FIG. 2 is a perspective view of the blank of FIG. 1 having adhesive borne thereon according to a first aspect of the present disclosure.

As mentioned above, FIGS. 2-7 show an illustrative sequence of construction of the preassembly 102 according to a first aspect of the present disclosure. More specifically, FIG. 2 shows adhesive applied to portions of the fourth section B4 of the auxiliary panel B. The adhesive is configured to adhere the fourth section B4 of the auxiliary panel B to the third section A3 of the side panel A. The adhesive may be a relatively fast setting adhesive, for example, a hot melt adhesive, or a relatively slow setting adhesive, for example a cold adhesive.

Figure 3:
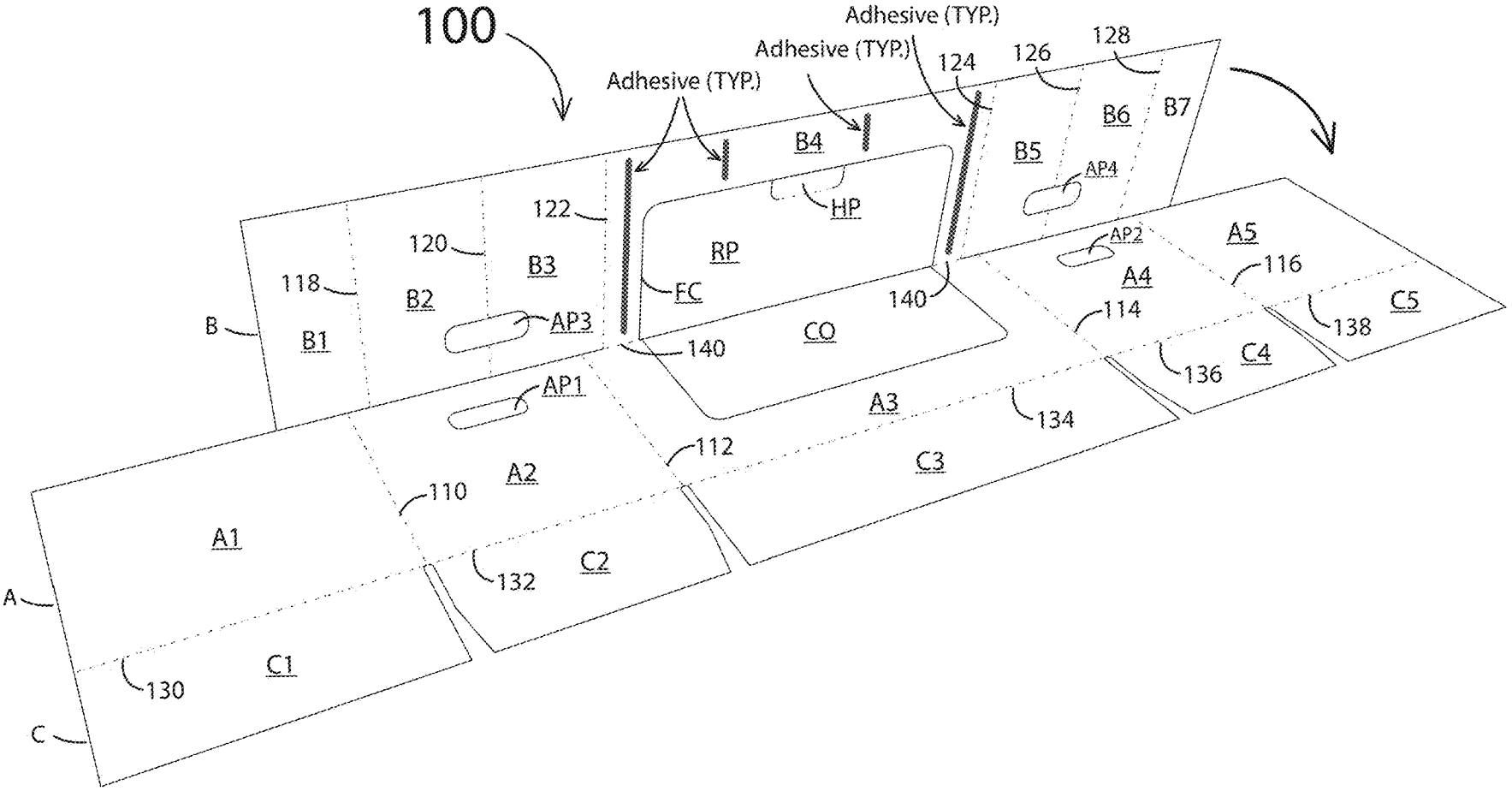
FIG. 3 is a perspective view of the blank of FIG. 1 partially manipulated to form a preassembly according to a first aspect of the present disclosure.

FIG. 3 shows the fourth section B4 of the auxiliary panel B being folded about the sixteenth fold line 140 toward the third section A3 of the side panel A. FIG. 3 also shows the first, second, third, fifth, sixth, and seventh sections B1, B2, B3, B5, B6, B7 of the auxiliary panel B being rotated toward corresponding ones of the first through fifth sections A1, A2, A3, A4, A5 of the side panel A.

Figure 4:
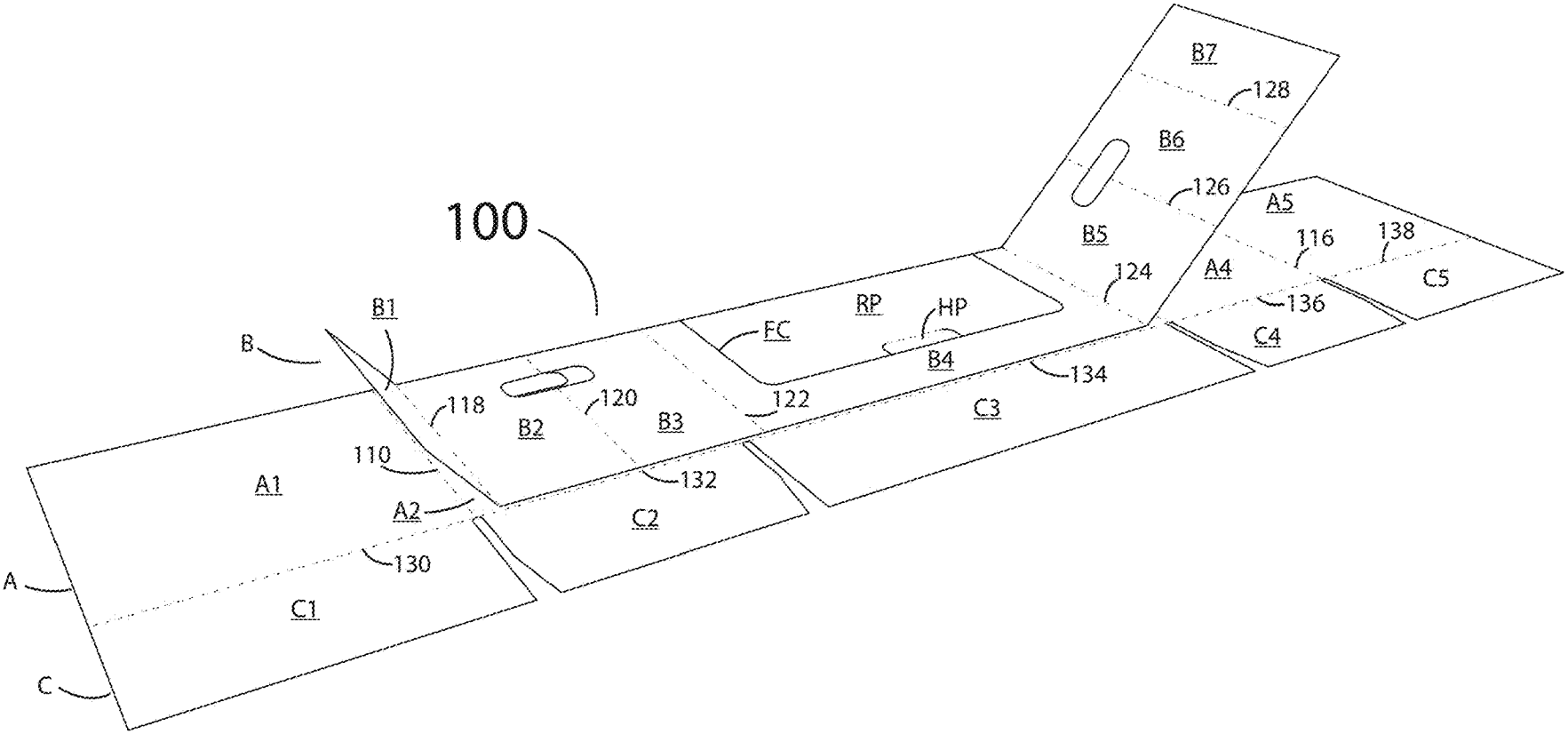
FIG. 4 is a perspective view of the blank of FIG. 1 further manipulated to form a preassembly according to the first aspect of the present disclosure.

FIG. 4 shows the fourth section B4 of the auxiliary panel B folded about the sixteenth fold line 140 against the third section A3 of the side panel A. With the fourth section B4 of the auxiliary panel B so folded against the third section A3 of the side panel A, the adhesive applied to the fourth section B4 of the auxiliary panel B as shown in FIG. 2 causes the fourth section B4 of the auxiliary panel B to become adhered to the third section A3 of the side panel A. FIG. 4 also shows the second section B2 of the auxiliary panel B folded against the second section A2 of the side panel A, and the third section B3 of the auxiliary panel B folded against the second and third sections A2, A3 of the side panel A. FIG. 4 further shows the first section B1 of the auxiliary panel B folded toward the second section B2 of the auxiliary panel B about the fifth fold line 118. FIG. 4 still further shows the fifth section B5 (and the sixth and seventh sections B6, B7) of the auxiliary panel B folded about the eighth fold line 124 toward the fourth section B4 of the auxiliary panel B.

Figure 5:
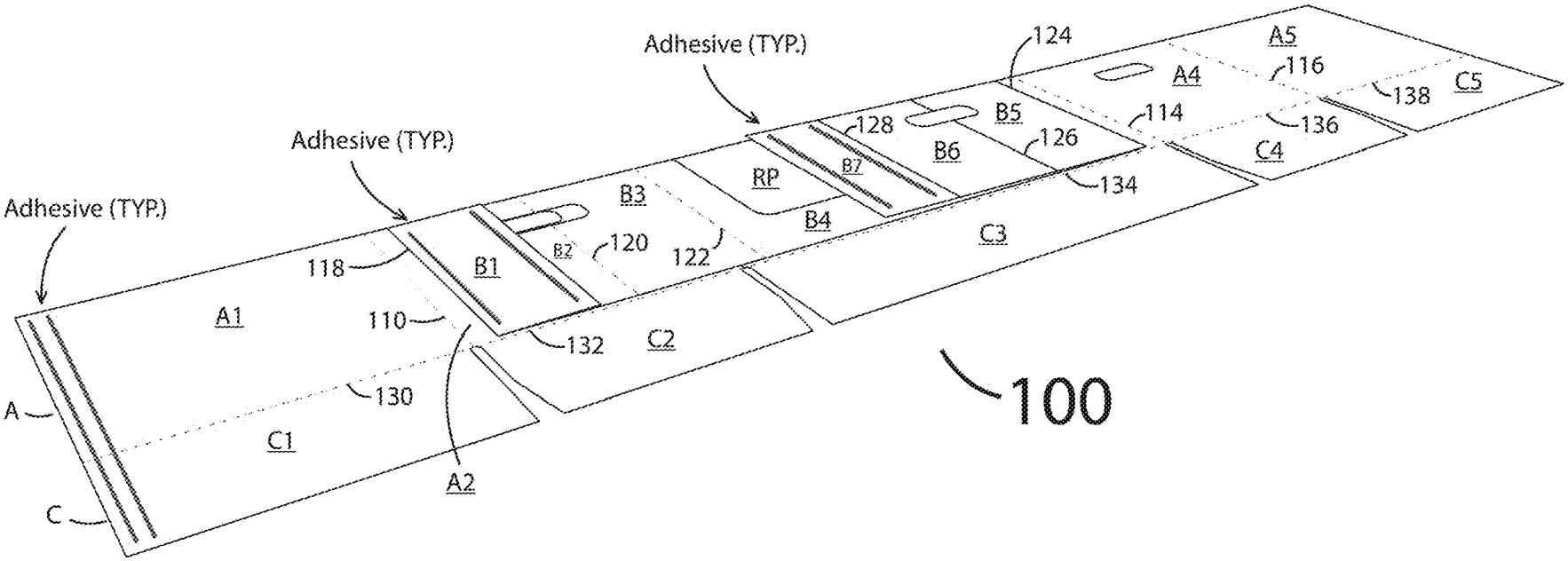
FIG. 5 is a perspective view of the blank of FIG. 1 still further manipulated to form a preassembly according to the first aspect of the present disclosure.

FIG. 5 shows the first section B1 of the auxiliary panel B folded about the fifth fold line 118 against the second section B2 of the auxiliary panel B. FIG. 5 also shows the fifth section B5 (and the sixth and seventh sections B6, B7) of the auxiliary panel B folded about the eighth fold line 124 against the fourth section B4 of the auxiliary panel B. FIG. 5 further shows adhesive applied to portions of respective exposed surfaces of the first and seventh sections B1, B7 (that is, the surfaces of the first and seventh sections B1, B7 opposite those surfaces of the first and seventh sections B1, B7 folded against the second and fourth sections B2, B4, respectively) of the auxiliary panel B. FIG. 5 still further shows adhesive applied to portions of the first sections A1, C1 of the side and bottom panels A, C. This adhesive may be a relatively slow setting adhesive, for example, a cold adhesive.

Figure 6:
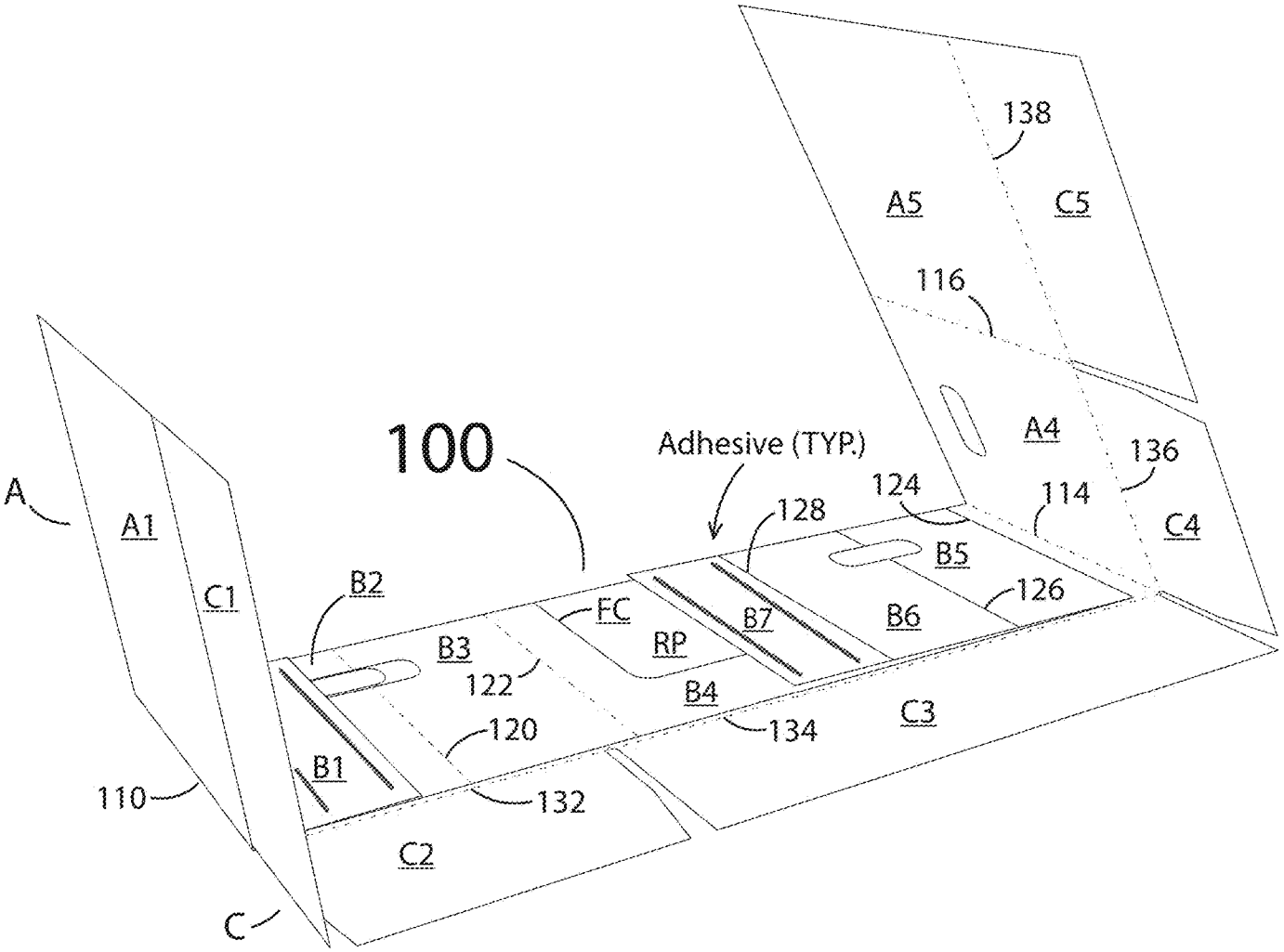
FIG. 6 is a perspective view of the blank of FIG. 1 yet further manipulated to form a preassembly according to the first aspect of the present disclosure.

FIG. 6 shows the fourth section A4 (and fifth section A5) of the side panel A folded about the third fold line 114 toward the third section A3 of the side panel A, and toward the fifth, sixth, and seventh section B5, B6, B7 of the auxiliary panel B overlying the third section A3 of the side panel A. FIG. 6 also shows the first section A1 of the side panel A folded about the first fold line 110 toward the second section A2 of the side panel A, and toward the first, second, and third sections B1, B2, B3 of the auxiliary panel B overlying the second section A2 of the side panel A.

Figure 7:
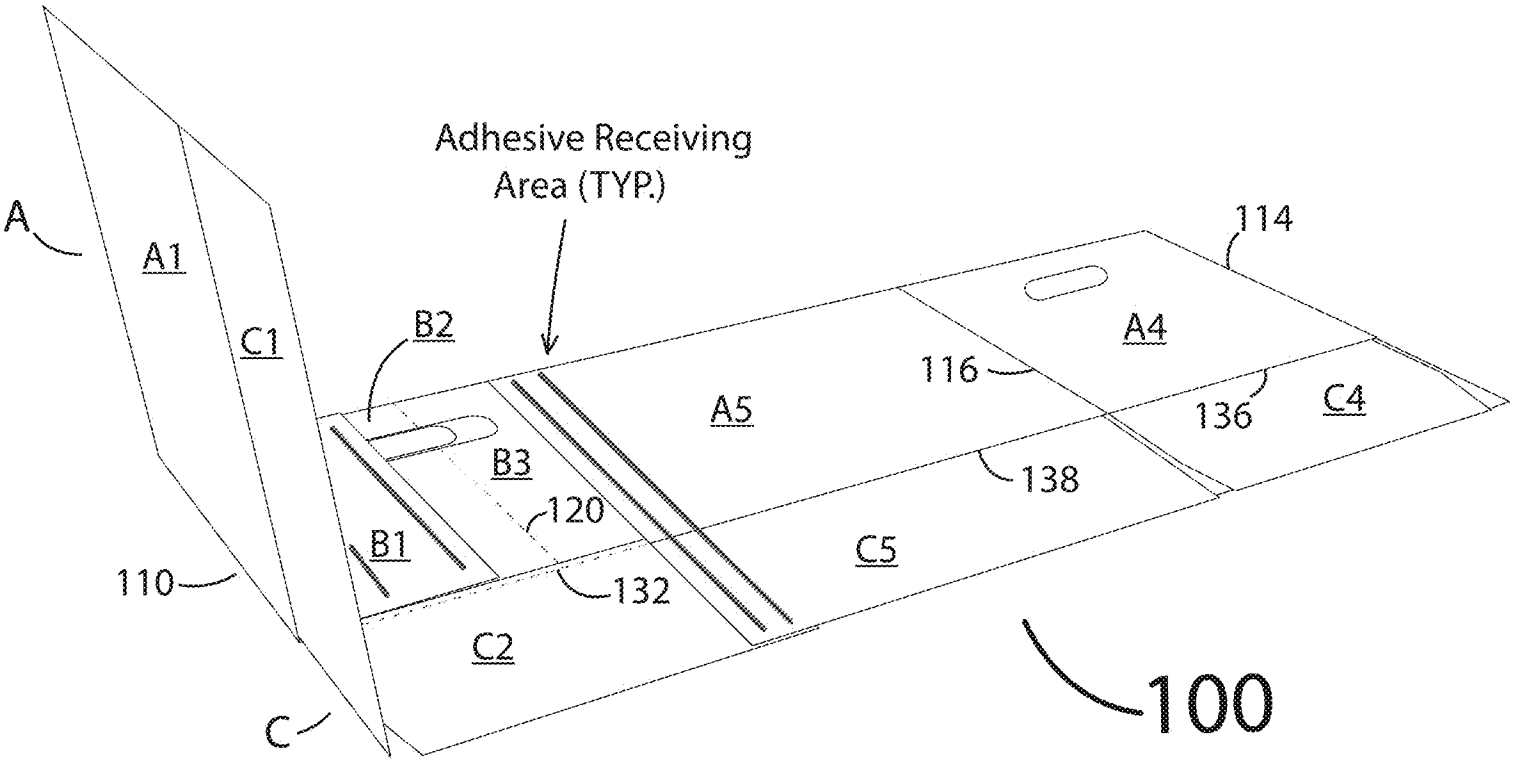
FIG. 7 is a perspective view of the blank of FIG. 1 still further manipulated to form a preassembly according to the first aspect of the present disclosure.

FIG. 7 shows the fourth section A4 (and fifth section A5) of the side panel A folded about the third fold line 114 against the third section A3 of the side panel A, and against the third, fourth fifth, sixth, and seventh sections B3, B4, B5, B6, B7 of the auxiliary panel B overlying the third section A3 of the side panel A. So folded, the adhesive applied to the seventh section B7 of the auxiliary panel B contacts the adjacent surface of the fifth section A5 of the side panel A, thereby adhering the seventh section B7 of the auxiliary panel B to the adjacent surface of the fifth section A5 of the side panel A. FIG. 7 also shows the first section A1 of the of the side panel A in the same position as shown in FIG. 6. FIG. 7 further shows an adhesive receiving area on the exposed surface of the fifth sections A5, C5 of the side and bottom panels A, C configured to receive the adhesive applied to the first sections A1, C1 of the side panels A, C, as shown in FIG. 5.

FIG. 13 shows the first section A1 of the side panel A folded against the second section A2 of the side panel A and against the intervening first, second, and third sections B1, B2, B3 of the auxiliary panel B to form the preassembly 102. So folded, the first section A1 of the side panel A of the blank 100 becomes adhered to the adhesive applied to the exposed surface of the first section B1 of the auxiliary panel B. Also, so folded, the adhesive applied to the inner surfaces of the first sections A1, C1 of the side and bottom panels A, C of the blank 100 contacts the corresponding adhesive receiving area defined by the outer surfaces of the fifth sections A5, C5 of the side and bottom panels A, C as shown in FIG. 7, thereby adhering such portions of the inner surfaces of the first sections A1, C1 of the side and bottom panels A, C to corresponding portions of the outer surfaces of the fifth sections A5, C5 of the side and bottom panels A, C.

Figure 8:
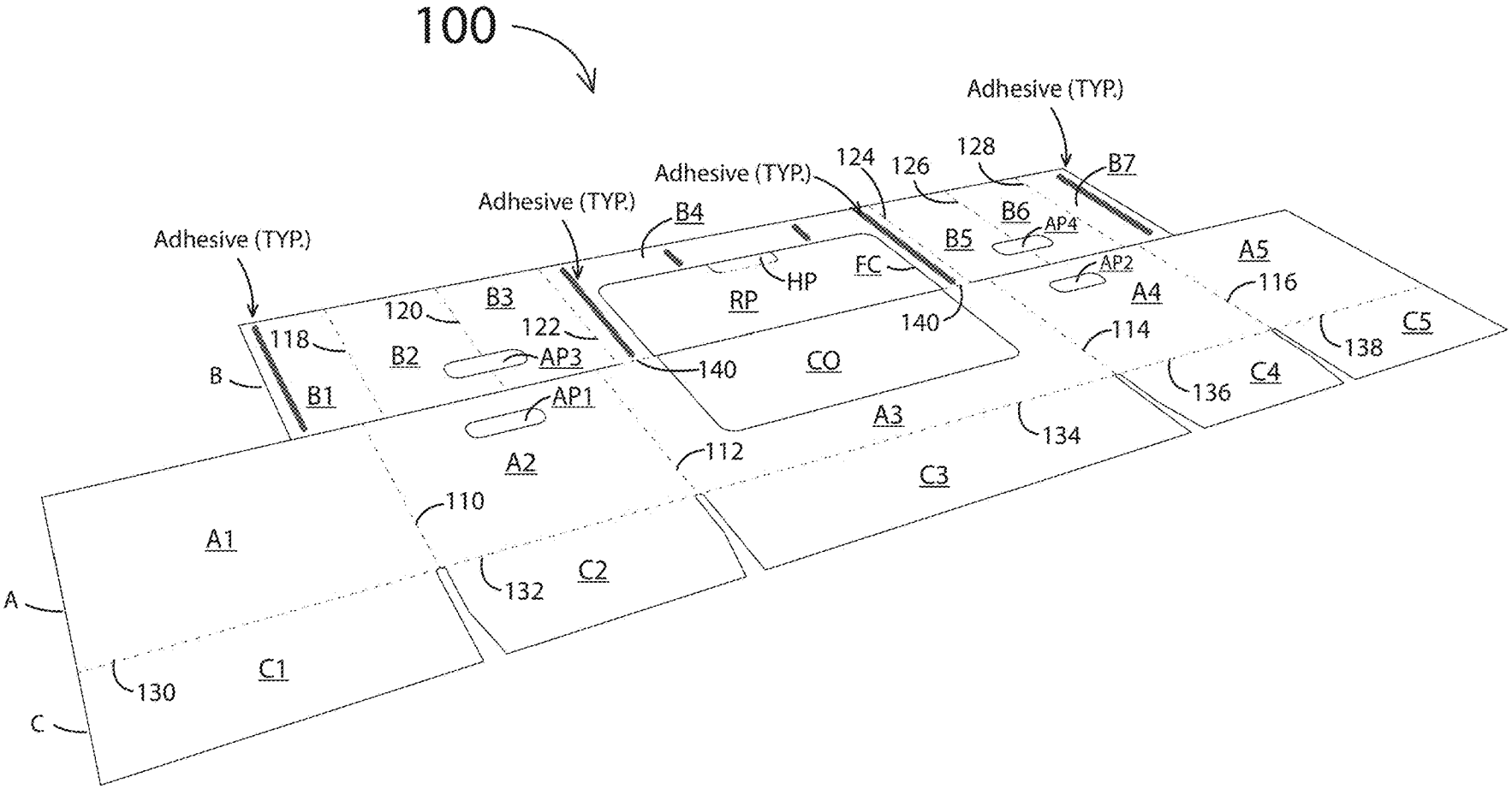
FIG. 8 is a perspective view of the blank of FIG. 1 having adhesive borne thereon according to a second aspect of the present disclosure.
Figure 9:
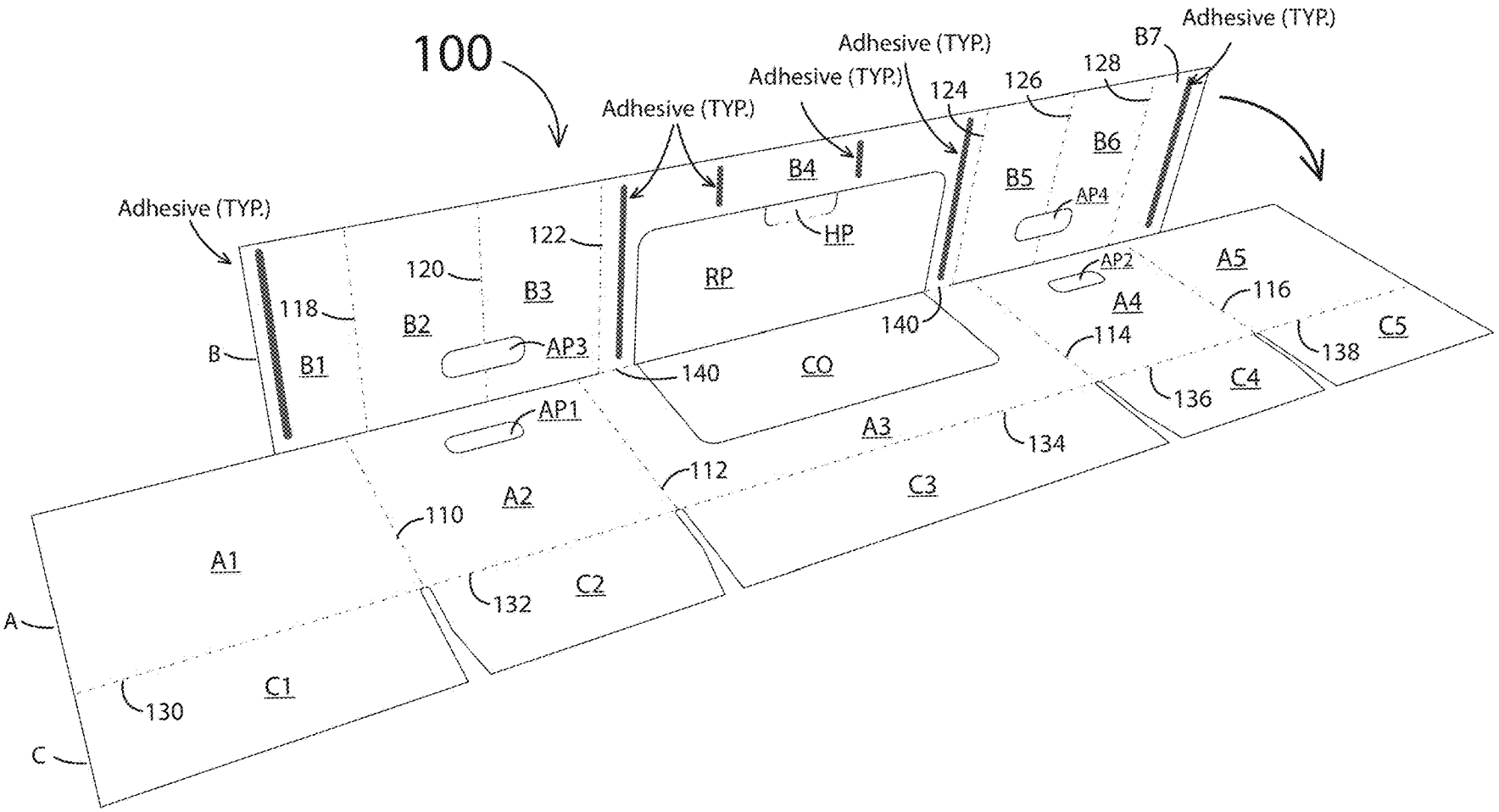
FIG. 9 is a perspective view of the blank of FIG. 1 partially manipulated to form a preassembly according to the second aspect of the present disclosure.

As mentioned above, FIGS. 8-11 show an illustrative sequence of construction of the preassembly 102 according to a second aspect of the present disclosure. More specifically, FIG. 8 shows adhesive applied to portions of the first, fourth, and seventh sections B1, B4, B7 of the auxiliary panel B. The adhesive applied to the fourth section B4 of the auxiliary panel B is configured to adhere the fourth section B4 of the auxiliary panel B to the third section A3 of the side panel A. This adhesive is a relatively fast setting adhesive, for example, a hot melt adhesive. The adhesive applied to the first section B1 of the auxiliary panel B is configured to adhere the first section B1 of the auxiliary panel B to the first section A1 of the side panel A. This adhesive is a relatively slow setting adhesive, for example, a cold adhesive. The adhesive applied to the seventh section B7 of the auxiliary panel B is configured to adhere the seventh section B7 of the auxiliary panel B to the fifth section A5 of the side panel A. This adhesive is a relatively slow setting adhesive, for example, a cold adhesive FIG. 9 shows the fourth section B4 of the auxiliary panel B being folded about the sixteenth fold line 140 toward the third section A3 of the side panel A. FIG. 9 also shows the first, second, third, fifth, sixth, and seventh sections B1, B2, B3, B5, B6, B7 of the auxiliary panel B being rotated toward corresponding ones of the first through fifth sections A1, A2, A3, A4, A5 of the side panel A.

Figure 10:
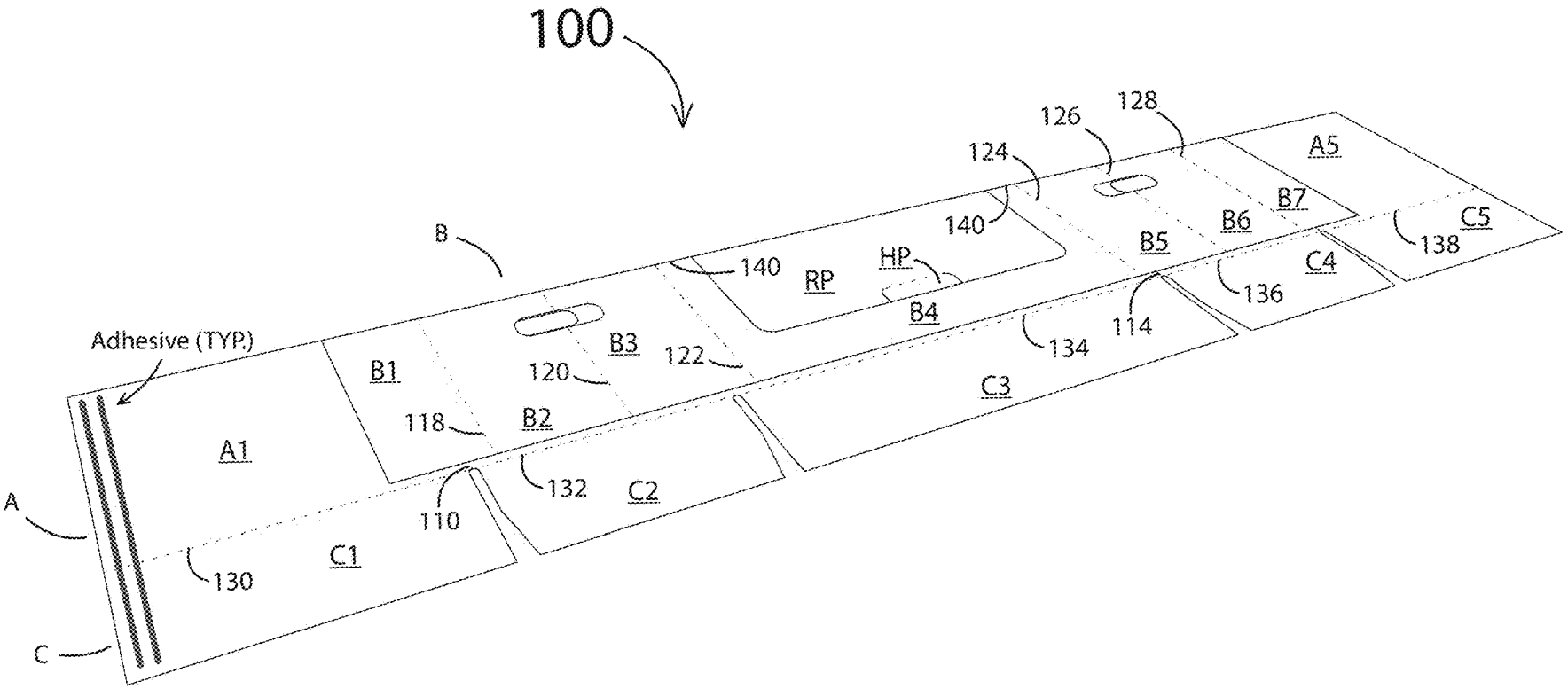
FIG. 10 is a perspective view of the blank of FIG. 1 further manipulated to form a preassembly according to the second aspect of the present disclosure.

FIG. 10 shows the fourth section B4 of the auxiliary panel B folded about the sixteenth fold line 140 against the third section A3 of the side panel A. With the fourth section B4 of the auxiliary panel B so folded against the third section A3 of the side panel A, the adhesive applied to the fourth section B4 of the auxiliary panel B as shown in FIG. 8 causes the fourth section B4 of the auxiliary panel B to become adhered to the third section A3 of the side panel A. FIG. 10 also shows the first section B1 of the auxiliary panel B folded against the first section A1 of the auxiliary panel A. With the first section B1 of the auxiliary panel B so folded against the first section A1 of the side panel A, the adhesive applied to the first section B1 of the auxiliary panel B as shown in FIGS. 8 and 9 comes into contact with the first section A1 of the side panel A. FIG. 10 further shows the seventh section B7 of the auxiliary panel B folded against the fifth section A5 of the auxiliary panel A. With the seventh section B7 of the auxiliary panel B so folded against the fifth section A5 of the side panel A, the adhesive applied to the seventh section B7 of the auxiliary panel B as shown in FIGS. 8 and 9 comes into contact with the fifth section A5 of the side panel A. Because the adhesive applied to the first and seventh sections B1, B7 of the auxiliary panel B is relatively slow setting, it does not immediately adhere the first and seventh sections B1, B7 of the auxiliary panel B to the corresponding first and fifth sections A1, A5 of the side panel A.

Figure 11:
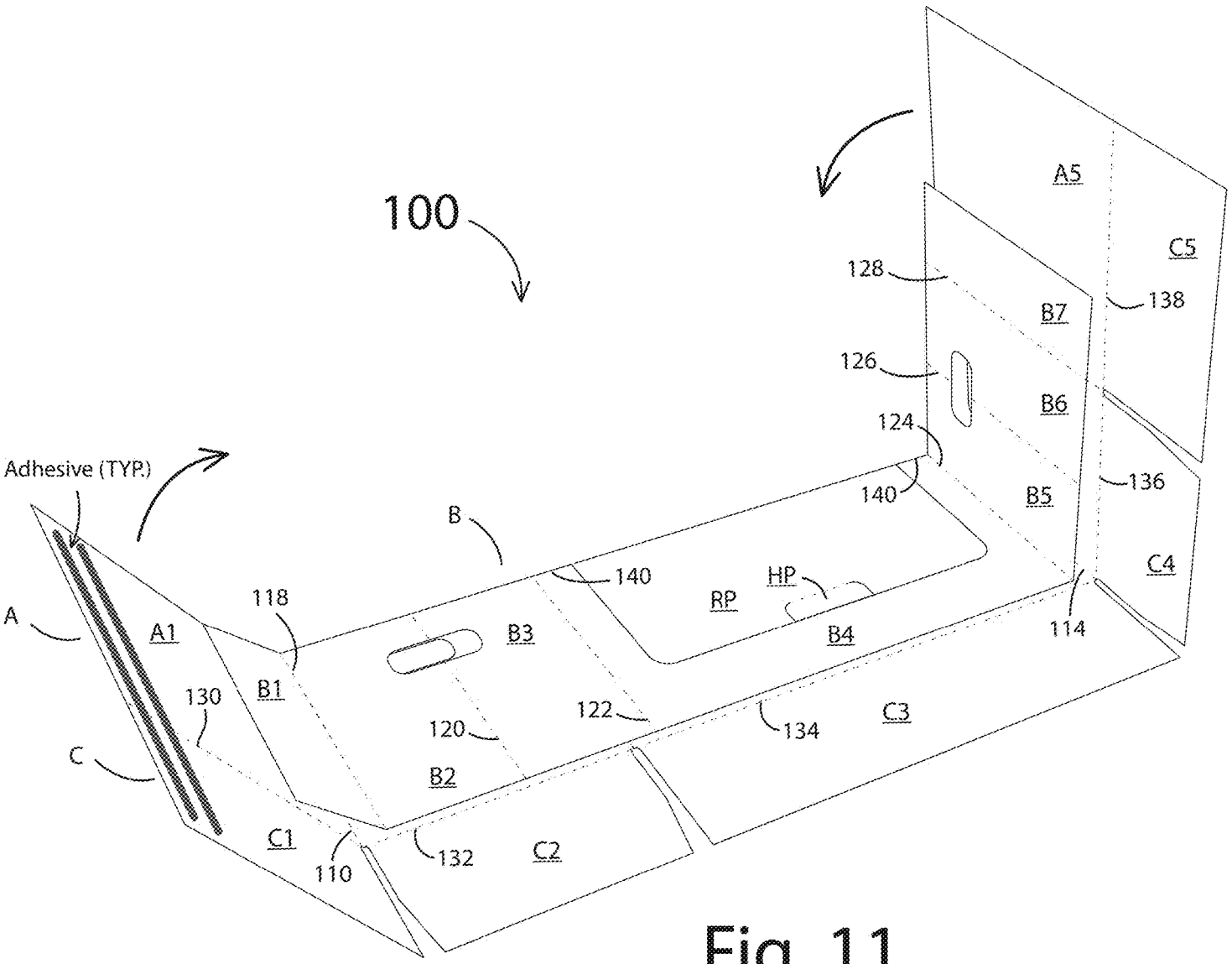
FIG. 11 is a perspective view of the blank of FIG. 1 still further manipulated to form a preassembly according to the second aspect of the present disclosure.

FIG. 11 shows the fifth section B5 (and the sixth and seventh sections B6, B7) folded about the eighth fold line 124 toward fourth section B4 of the auxiliary panel B. FIG. 11 also shows the fourth section A4 of the side panel A folded about the third fold line 114 toward the third section A3 of the side panel A. In typical practice, the folding of the fourth section A4 of the side panel A about the third fold line 114 would cause the folding of the fifth section B5 of the auxiliary panel B about the eighth fold line 124, as would be understood by one skilled in the art. In the course of such folding, the adhesive applied to the seventh section B7 of the auxiliary panel B (as shown in FIG. 8) would smear against the corresponding opposed surface of the fifth section A5 of the side panel A.

FIG. 11 further shows the first section A1 of the side panel A folded about the first fold line 110 toward the second section A2 of the side panel A. FIG. 11 still further shows the first section B1 of the auxiliary panel B folded about the fourth fold line 118 toward the second section B2 of the auxiliary panel B. In typical practice, the folding of the first section A1 of the side panel A about the first fold line 110 would cause the folding of the first section B1 of the auxiliary panel B about the fourth fold line 118, as would be understood by one skilled in the art. In the course of such folding, the adhesive applied to the first section B1 of the auxiliary panel B (as shown in FIG. 8) would smear against the corresponding opposed surface of the first section A1 of the side panel A.

FIG. 12 shows the fourth section A4 (and fifth section A5) of the side panel A folded about the third fold line 114 against the third section A3 of the side panel A and the intervening fourth, fifth, sixth, and seventh portions B4, B5, B6, B7 of the auxiliary panel (the intervening fourth, fifth, sixth, and seventh portions B4, B5, B6, B7 of the auxiliary panel B are obscured by the third and fourth sections A3, A4 of the side panel A in FIG. 12). FIG. 12 also shows an adhesive receiving area on the exposed surfaces of the first sections A1, C1 of the side and bottom panels A, C parallel to and opposite fourth fold line 116. FIG. 12 further shows the first section A1 of the side panel A further folded about the first fold line 110 toward the second section A2 of the side panel and the intervening second and third sections B2, B3 of the auxiliary panel B and partially against the first section B1 of the auxiliary panel B.

FIG. 13 shows the first section A1 of the side panel A folded against the second section A2 of the side panel A and against the intervening first, second, and third sections B1, B2, B3 of the auxiliary panel B to form the preassembly 102. So folded, the first section A1 of the side panel A of the blank 100 becomes adhered to the adhesive applied to the exposed surface of the first section B1 of the auxiliary panel B. Also, so folded, the adhesive applied to the inner surfaces of the first sections A1, C1 of the side and bottom panels A, C of the blank 100 contacts the corresponding adhesive receiving area defined by the outer surfaces of the fifth sections A5, C5 of the side and bottom panels A, C as shown in FIG. 7, thereby adhering such portions of the inner surfaces of the first sections A1, C1 of the side and bottom panels A, C to corresponding portions of the outer surfaces of the fifth sections A5, C5 of the side and bottom panels A, C.

The foregoing discussions of the first and second aspects of the disclosure identify certain locations where adhesive is applied to the blank 100. In embodiments, any or all such adhesives could instead be applied to the corresponding adhesive receiving areas.

FIGS. 14-17 show illustrative erection of a container 104 from the preassembly 102 according to the present disclosure.

Figure 15:
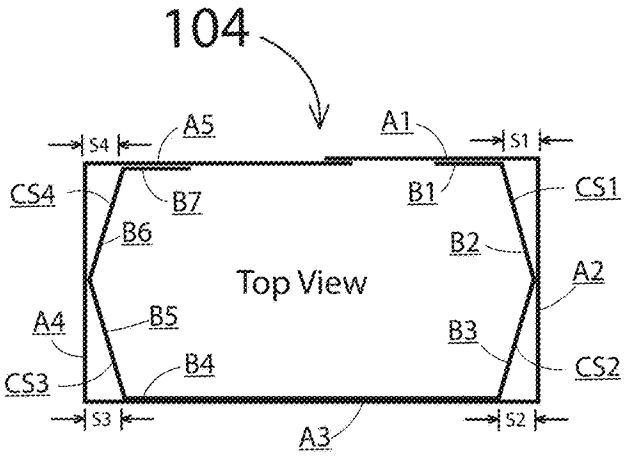
FIG. 15 is a top plan view of the partially erected container of FIG. 14.
Figure 14:
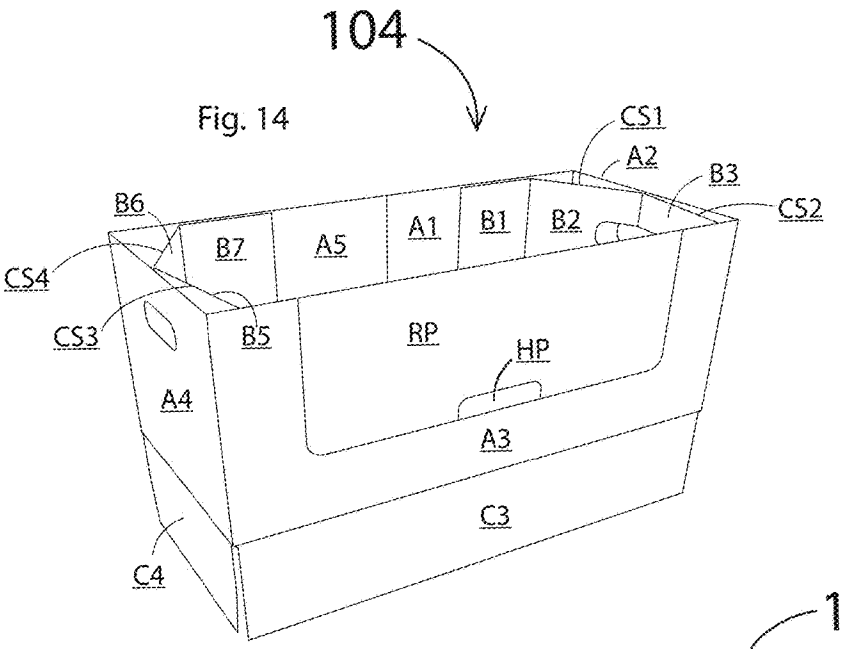
FIG. 14 is a perspective view of the preassembly of FIG. 13 partially erected into a container.

With reference to FIGS. 14 and 15, the container 104 may be partially erected from the preassembly 102 by manipulating the preassembly 102 as follows. The first section A1 of the side panel A is folded away from the second section A2 of the side panel A along the first fold line 110 to a position perpendicular to the second section A2 of the side panel A. The second section A2 of the side panel A is folded toward the third section A3 of the side panel A along the second fold line 112 to a position perpendicular to the third section A3 of the side panel A. The third section A3 of the side panel is folded away from the fourth section A4 of the side panel A along the third fold line 114 to a position perpendicular to the fourth section A4 of the side panel A. The fourth section A4 of the side panel A is folded toward the fifth section A5 of the side panel A along the fourth fold line 116 to a position perpendicular to the fifth section A5 of the side panel A.

Based on the adherence of the first section A1 of the side panel A to the first section B1 of the auxiliary panel B, the adherence of the third section A3 of the side panel A to the fourth section B4 of the auxiliary panel B, and the adherence of the fifth section A5 of the side panel A to the seventh section B7 of the auxiliary panel B, the foregoing manipulation of the preassembly 102 causes: (a) the first section B1 of the auxiliary panel B to fold away from the second section B2 of the auxiliary panel B about the fifth fold line 118; (b) the third section B3 of the auxiliary panel B to fold toward the fourth section B4 of the auxiliary panel B; (c) the fourth section B4 of the auxiliary panel B to fold away from the fifth section B5 of the auxiliary panel B; and (d) the sixth section B6 of the auxiliary panel B to fold toward the seventh section B7 of the auxiliary panel B.

The foregoing folding of the sections B1, B2, B3, B4, B5, B6, B7 of the secondary blank 102 away from or toward each other shortens the perpendicular distance between the fifth and seventh fold lines 118, 122, thereby creating a compressive force pushing the second and third sections B2, B3 of the auxiliary panel B toward each other. This compressive force causes the second section B2 of the auxiliary panel B to fold toward the third section B3 of the auxiliary panel B along the sixth fold line 120, thereby forming first and second corner supports CS1, CS2. Similarly, the foregoing folding of the sections B1, B2, B3, B4, B5, B6, B7 of the auxiliary panel B away from or toward each other shortens the perpendicular distance between the eighth and tenth fold lines 124, 128, thereby creating a compressive force pushing the fifth and sixth sections B5, B6 of the auxiliary panel B toward each other. This compressive force causes the fifth section B5 of the auxiliary panel B to fold toward the sixth section B6 of the auxiliary panel B along the ninth fold line 126, thereby forming third and fourth corner supports CS3, CS4.

The extent to which the foregoing sections B1, B2, B3, B4, B5, B6, B7 of the auxiliary panel B fold away from or toward each other is a function of the first, second, third, and fourth distances S1, S2, S3, S4. The greater the magnitude of the first, second, third, and fourth distances S1, S2, S3, S4, the further the corresponding sections B1, B2, B3, B4, B5, B6, B7 of the auxiliary panel B fold away from or toward each other. Similarly, the shapes of the corner supports CS1, CS2, CS3, CS4 are functions of the first, second, third, and fourth distances S1, S2, S3, S4. The greater the magnitude of the first, second, third, and fourth distances S1, S2, S3, S4, the further the respective corner supports extend away from corresponding ones of the second and fourth sections A2, A4 of the side panel A.

Figure 16:
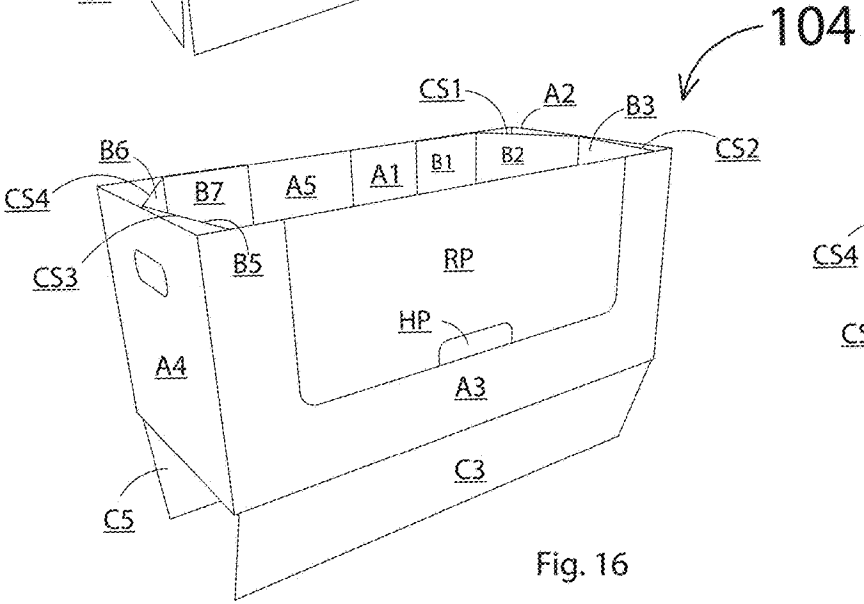
FIG. 16 is a perspective view of the preassembly of FIG. 13 further erected into a container.

FIG. 16 shows a configuration of the preassembly 102 wherein the second and fourth sections C2, C4 of the bottom panel C, respectively, have been folded about the twelfth and fourteenth fold lines 132, 136 to positions perpendicular to the second and fourth sections A2, A2 of the side panel A. In FIG. 16, the second and fourth sections C2, C4 of the bottom panel C and the second section A2 of the side panel are obscured by the third and fourth sections A3, A4 of the side panel.

Figure 17:
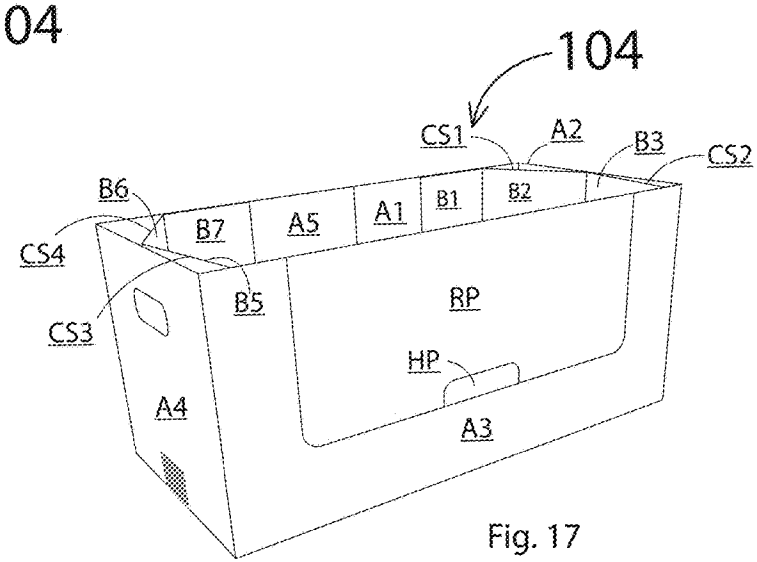
FIG. 17 is a perspective view of a container erected from the preassembly of FIG. 13.

FIG. 17 shows a configuration in which the first, third, and fifth sections C1, C3, C5 of the bottom panel C, respectively, have been folded about the eleventh, thirteenth, and fifteenth fold lines 130, 134, 138 to positions perpendicular to the first, third, and fifth sections A1, A3, A5 of the side panel A. In FIG. 17, the first, third, and fifth sections C1, C3, C5 of the bottom panel C are obscured by the third and fourth sections A3, A4 of the side panel A.

In use, the removable panel RP may be removed, for example, by inserting a finger or fingers through any one or more of the hinged panels HP1, HP2, HP3, HP4 and pulling the removable panel RP away from the third side and third top sections A3, B3 of the primary blank 100, thereby tearing breaking the frangible connection FC. Because the removable portion RP extends beyond the free edge of the third section A3 of the side panel A, the broken frangible connection FC resulting from the removal of the removable portion RP from the fourth section B4 of the auxiliary panel B might not be visible when the container is viewed from a perspective perpendicular to the third section A3 of the side panel A.

As suggested above, another container, for example, another container 10,4 can be stacked atop the container 104 and be supported by the internal corner supports CS1, CS2, CS3, CS4.

The invention claimed is:

1. A blank for retail-ready container, the blank comprising:

a side panel comprising;

a first section;

a second section connected to the first section along a first fold line;

a third section connected to the second section along a second fold line parallel to the first fold line;

a fourth section connected to the third section along a third fold line parallel to the first fold line; and a fifth section connected to the fourth section along a fourth fold line parallel to the first fold line;

an auxiliary panel comprising:

a first section;

a second section connected to the first section along a fifth fold line parallel to the first fold line;

a third section directly connected to the second section along a sixth fold line parallel to the first fold line;

a fourth section connected to the third section along a seventh fold line parallel to the first fold line;

a fifth section connected to the fourth section along an eighth fold line parallel to the first fold line;

a sixth section connected to the fifth section along a ninth fold line parallel to the first fold line;

a seventh section connected to the sixth section along a tenth fold line parallel to the first fold line; and a bottom panel comprising:

a first section connected to the first section of the side panel along an eleventh fold line perpendicular to the first fold line;

a second section connected to the second section of the side panel along a twelfth fold line perpendicular to the first fold line;

a third section connected to the third section of the side panel along a thirteenth fold line perpendicular to the first fold line;

a fourth section connected to the fourth section of the side panel along a fourteenth fold line perpendicular to the first fold line; and a fifth section connected to the fifth section of the side panel along a fifteenth fold line perpendicular to the first fold line;

wherein the fourth section of the auxiliary panel is connected to the third section of the side panel along a sixteenth fold line perpendicular to the first fold line;

wherein a first cut line parallel to the sixteenth fold line extends from the seventh fold line to a free edge of the auxiliary panel proximate the first section of the side panel, the first cut line separating the first section of the auxiliary panel from the first section of the side panel;

wherein a second cut line parallel to the sixteenth fold line extends from the eighth fold line to a free edge of the auxiliary panel proximate the fifth section of the side panel, the second cut line separating the seventh section of the auxiliary panel from the fifth section of the side panel, wherein the blank is configured so that the fourth section of the auxiliary panel is foldable along the sixteenth fold line against the third section of the side panel to enable adhesive connection of the fourth section of the auxiliary panel to the third section of the side panel, and wherein the blank is configured so that the first section of the auxiliary panel is foldable along the fifth fold line against the first section of the side panel to enable adhesive connection of the first section of the auxiliary panel to the first section of the side panel, so that the blank may be manipulated between a flat configuration and an erected configuration wherein the second auxiliary panel extends from the first side panel toward the second side panel and the third auxiliary panel extends from the third aside panel toward the second side panel.

2. The blank of claim 1 further comprising a removable portion frangibly connected to the fourth section of the auxiliary panel, wherein the removable portion has a shape complementary to a shape of a corresponding cutout defined by the third section of the side panel.

3. The blank of claim 2 wherein the removable portion has at least one dimension greater than a corresponding dimension of the cutout.

4. The blank of claim 1 further comprising a removable portion having a first section frangibly connected to the fourth section of the auxiliary panel and a second section frangibly connected to the third section of the side panel, wherein the first section of the removable portion has a shape complementary to a shape of the second section of the removable portion.

5. The blank of claim 4 wherein the first section of the removable portion has at least one dimension greater than a corresponding dimension of the second section of the removable portion.

6. A preassembly formed from the blank of claim 1 wherein the auxiliary panel is folded about the sixteenth fold line against the side panel and wherein the fourth section of the auxiliary panel is adhered to the third section of the side panel.

7. The preassembly of claim 6, wherein the first section of the auxiliary panel is folded about the fifth fold line against the second section of the auxiliary panel, the fifth section of the auxiliary panel is folded about the eighth fold line against the fourth section of the auxiliary panel, the first section of the side panel is folded about the first fold line against the first section of the auxiliary panel, the fourth section of the side panel is folded about the third fold line, the first section of the side panel is adhered to the first section of the auxiliary panel, the fifth section of the side panel is adhered to the seventh section of the auxiliary panel, and the fifth section of the side panel is adhered to the first section of the side panel.

8. A retail-ready container formed from the preassembly of claim 7, wherein the first section of the side panel is folded along the first fold line to a position perpendicular to the second section of the side panel, the second section of the side panel is folded along the second fold line to a position perpendicular to the third section of the side panel, the third section of the side panel is folded along the third fold line to a position perpendicular to the fourth section of the side panel, the fourth section of the side panel is folded along the fourth fold line to a position perpendicular to the fifth section of the side panel.

9. The retail-ready container of claim 8, wherein the first section of the auxiliary panel is folded along the fifth fold line with respect to the second section of the auxiliary panel, the second section of the side panel is folded along the sixth fold line with respect to the third section of the auxiliary panel, the third section of the auxiliary panel is folded along the seventh fold line with respect to the fourth section of the auxiliary panel, the fourth section of the auxiliary panel is folded along the eighth fold line with respect to the fifth section of the auxiliary panel, the fifth section of the auxiliary panel is folded along the ninth fold line with respect to the sixth section of the auxiliary panel, and the sixth section of the auxiliary panel is folded along the tenth fold line with respect to the seventh section of the auxiliary panel.

10. The retail-ready container of claim 9, wherein the fifth fold line is adjacent or abuts the first section of the side panel, and the sixth fold line is adjacent or abuts the second section of the side panel.

11. The retail-ready container of claim 10, wherein the fifth fold line is parallel to the second section of the side panel and is spaced from the second section of the side panel by a first distance.

12. The retail-ready container of claim 11, wherein the seventh fold line is adjacent or abuts the third section of the side panel.

13. The retail-ready container of claim 10, wherein the seventh fold line is parallel to the second section of the side panel and is spaced from the second section of the side panel by a second distance.

14. The retail-ready container of claim 13, wherein the eighth fold line is adjacent or abuts the third section of the side panel, and the ninth fold line is adjacent or abuts the fourth section of the side panel.

15. The retail-ready container of claim 14, wherein the eighth fold line is parallel to the fourth section of the side panel and is spaced from the fourth section of the side panel by a third distance.

16. The retail-ready container of claim 15, wherein the tenth fold line is adjacent or abuts the fifth section of the side panel.

17. The retail-ready container of claim 16, wherein the tenth fold line is parallel to the fourth section of the side panel and is spaced from the fourth section of the side panel by a fourth distance.

18. The retail-ready container of claim 9, wherein the second section of the auxiliary panel cooperates with the first and second sections of the side panel to define a first support structure.

19. The retail-ready container of claim 18, wherein the third section of the auxiliary panel cooperates with the second and third sections of the side panel to define a second support structure.

20. A method of making a preassembly for a retail-ready container comprising the steps of:

providing a blank comprising:

a side panel comprising;

a first section;

a second section connected to the first section along a first fold line;

a third section connected to the second section along a second fold line parallel to the first fold line;

a fourth section connected to the third section along a third fold line parallel to the first fold line; and a fifth section connected to the fourth section along a fourth fold line parallel to the first fold line;

an auxiliary panel comprising:

a first section;

a second section connected to the first section along a fifth fold line parallel to the first fold line;

a third section directly connected to the second section along a sixth fold line parallel to the first fold line;

a fourth section connected to the third section along a seventh fold line parallel to the first fold line;

a fifth section connected to the fourth section along an eighth fold line parallel to the first fold line;

a sixth section connected to the fifth section along a ninth fold line parallel to the first fold line;

a seventh section connected to the sixth section along a tenth fold line parallel to the first fold line; and a bottom panel comprising:

a first section connected to the first section of the side panel along an eleventh fold line perpendicular to the first fold line;

a second section connected to the second section of the side panel along a twelfth fold line perpendicular to the first fold line;

a third section connected to the third section of the side panel along a thirteenth fold line perpendicular to the first fold line;

a fourth section connected to the fourth section of the side panel along a fourteenth fold line perpendicular to the first fold line; and a fifth section connected to the fifth section of the side panel along a fifteenth fold line perpendicular to the first fold line;

wherein the fourth section of the auxiliary panel is connected to the third section of the side panel along a sixteenth fold line perpendicular to the first fold line;

wherein a first cut line parallel to the sixteenth fold line extends from the seventh fold line to a free edge of the auxiliary panel proximate the first section of the side panel, the first cut line separating the first section of the auxiliary panel from the first section of the side panel;

wherein a second cut line parallel to the sixteenth fold line extends from the eighth fold line to a free edge of the auxiliary panel proximate the fifth section of the side panel, the second cut line separating the seventh section of the auxiliary panel from the fifth section of the side panel;

wherein the blank is configured so that the fourth section of the auxiliary panel is foldable along the sixteenth fold line against the third section of the side panel to enable adhesive connection of the fourth section of the auxiliary panel to the third section of the side panel; and wherein the blank is configured so that the first section of the auxiliary panel is foldable along the fifth fold line against the first section of the side panel to enable adhesive connection of the first section of the auxiliary panel to the first section of the side panel, so that the blank may be manipulated between a flat configuration and an erected configuration wherein the second auxiliary panel extends from the first side panel toward the second side panel and the third auxiliary panel extends from the third side panel toward the second side panel;

folding the auxiliary panel about the sixteenth fold line against the side panel;

adhering the fourth section of the auxiliary panel to the third section of the side panel;

folding the first section of the auxiliary panel about the fifth fold line against the second section of the auxiliary panel;

folding the fifth section of the auxiliary panel about the eighth fold line against the fourth section of the auxiliary panel;

folding the first section of the side panel about the first fold line against the first section of the auxiliary panel;

folding the fourth section of the side panel about the third fold line;

adhering the first section of the side panel to the first section of the auxiliary panel;

adhering the fifth section of the side panel to the seventh section of the auxiliary panel; and adhering the fifth section of the side panel to the first section of the side panel.

21. A method of making a retail-ready container comprising the steps of:

making a preassembly according to claim 20;

folding the first section of the side panel along the first fold line to a position perpendicular to the second section of the side panel;

folding the second section of the side panel along the second fold line to a position perpendicular to the third section of the side panel;

folding the third section of the side panel along the third fold line to a position perpendicular to the fourth section of the side panel;

folding the fourth section of the side panel along the fourth fold line to a position perpendicular to the fifth section of the side panel.

* * * * *